United States Patent [19]

Ohashi et al.

[11] Patent Number: 4,589,261

[45] Date of Patent: May 20, 1986

[54] ICE MAKING MACHINE AND METHOD OF MANUFACTURE THEREOF

[75] Inventors: Ryutaro Ohashi, Sakai; Hisashi Hasegawa, Kawachinagano; Masao Miyoshi, Kamagaya; Hajime Iida, Sakai; Toshiyuki Mase, Hirakata; Takashi Tanaka, Sakai; Tsunemasa Funatsu, Sakai; Tami Nakanishi, Sakai, all of Japan

[73] Assignee: Daikin Industries, Ltd., Osaka, Japan

[21] Appl. No.: 558,759

[22] Filed: Dec. 6, 1983

[51] Int. Cl.[4] ..... F25C 5/10

[52] U.S. Cl. ..... 62/73; 62/347

[58] Field of Search ..... 62/347, 348, 352, 73, 62/74; 285/DIG. 22; 248/68.1, 74.2

[56] References Cited

U.S. PATENT DOCUMENTS

| | | | |
|---|---|---|---|
| 2,892,823 | 6/1959 | Woodmark et al. | 62/347 |
| 2,983,109 | 5/1961 | Leeson | 62/73 |
| 3,206,944 | 9/1965 | Gallo | 62/347 |
| 3,430,452 | 3/1969 | Dedricks et al. | 62/138 |
| 3,803,871 | 4/1974 | Karas | 62/348 |
| 3,913,349 | 10/1975 | Johnson | 62/352 |
| 4,401,156 | 8/1983 | Wojtecki et al. | 165/172 |
| 4,412,429 | 11/1983 | Kohl | 62/347 |

*Primary Examiner*—William E. Tapolcai

*Attorney, Agent, or Firm*—Wenderoth, Lind & Ponack

[57] ABSTRACT

A ice making machine having a plurality of novel ice making plates or more preferably cylindrical ice making plates, which is formed to be longitudinal cell type wherein said ice making plates proper can be integrally fabricated by extrusion or drawing of heat conductive material, to have a means of fixing cooling tubing thereto by expanding, to be constructed said ice making plates proper and distance pieces made of heat insulating material being piled up alternately upon each other, to be constructed said cooling tubing being fixed thereto by expanding and thus to be assembled ice making plates having a predetermined size and number of ice cube making chambers therein.

13 Claims, 13 Drawing Figures

ICE MAKING MACHINE AND METHOD OF MANUFACTURE THEREOF

BACKGROUND OF THE INVENTION

The present invention relates to the method of manufacture as well as the construction and shape of an ice making machine having a plurality of ice making plates of longitudinal cell type for the production of ice cubes.

DESCRIPTION OF THE PRIOR ART

Conventionally, as to an ice making machine having an ice making plate of longitudinal cell type, for example, those described in the specification and drawings of U.S. Pat. No. 3,430,452 are well known. As shown in FIG. 1(*a*), this ice making machine is so constructed and arranged that a base plate(a) which utilizes surface thereof for ice making, a plurality of longitudinal partition walls(b) which are projected and provided longitudinally at the spacing of the lateral width of ice cube and a plurality of lateral partition walls(c) which are projected and provided laterally at the spacing of the longitudinal width of ice cube constitutes a flat plate ice making plate(e) that has a plurality of ice cube making chamber(d) "cell", said ice making plate (e) being installed approximately vertically in the casing(f), water being dripped from above so as to successively wet the upper surface of the lateral partition wall(c), the end surface thereof, the lower surface thereof and the surface of said base plate and thus ice cubes are made in each ice cube making cell(d).

As shown in FIG. 1(*b*), the above stated conventional ice making plate of flat plate type is provided with a serpentine copper tubing(g) on the back surface of said copper base plate(a), said serpentine copper tubing(g) being fixed therewith by soldering(h) and the entire ice making plate is plated with tin in order to remove the toxicity effect of soldering. With the conventional ice making machine, the troublesome and costly process of soldering is necessary and moreover, in order to eliminate the toxicity effect of soldering, it requires an extra process of plating the entire ice making plate with expensive material of tin, which results in high manufacturing cost.

Furthermore, as shown in FIG. 1(*a*), the conventional ice making plate is integrally fabricated. Therefore, when it is required to make changes in the size or number of ice cubes to be made, it is necessary to prepare a special die in accordance with the respective requirement, which lacks in the versatility of an ice making plate and requires a variety of special dies.

Furthermore, as shown enlarged in FIG. 1(*c*), with the conventional longitudinal ice making plate, the lateral partition walls(c) are integrally fabricated (or independently formed) together with said base plate(a) using high heat conductive material of such as copper. Since water drips from the upper ice cube making cell to the lower one across the upper surface(c1) of said lateral partition wall(c), the outer end surface(c2) thereof and the lower surface(c3) thereof, ice making is performed at said outer end surface(c2) of said lateral partition wall(c), which results in the joining of the ice (s) in the upper and lower ice cube making cells(d)(d). As a result, it is necessary to have another means of breaking such as a cutting grid-heated or a breaker in order to get ice cubes.

Furthermore, due to the limitation of the installation space, it is recently desired to compactize such an ice making machine. With the conventional type, since said ice making plate(e) is of flat plate type, the increase in the ice making capacity is limited within the limited space available and the way of maximizing the ice making capacity increase is to place, as shown in FIG. 1(*a*), ice making plate(e) diagonally in the box-type casing(f). Further, in case of the removal of ice cubes from ice cube making cells(d) and subsequent gravity fall thereof, ice cubes fall and piled up only on the line along the lower end of said ice making plate of flat plate type(e) and therefore the increase in the stored volume is also limited, which results in the disadvantage of being unable to compactize sufficiently.

SUMMARY OF THE INVENTION

In view of the above mentioned, an objective of the present invention is to provide an ice making plate of an ice making machine which is speedy to fabricate and highly accurate and simple in construction thereof. In order to achieve this objective, an ice making plate of an ice making machine of this invention is so constructed and characterized that a base plate utilizing outer surface thereof as a freezing surface, a plurality of partition plates projectingly provided on the outer surface of said base plate longitudinally at the spacing of the width of ice cube and a plurality of hollow tubular bodies projectingly provided longitudinally on the back surface of said base plate are integrally fabricated to constitute an ice making plate proper and cooling tubes are inserted into the hollow portion of said hollow tubular bodies and fixed together.

Furthermore, another objective of the present invention is to provide an ice making machine wherein it is easy to assemble an ice making plate so as to meet the requirements in ice making capacity and it is also easy to make changes in the capacity of an ice making plate by piling up ice making plates proper of a height equivalent to that of ice cubes making cell and distance pieces alternately upon each other. In order to achieve this objective, this invention is so constructed and characterized that a base plate utilizing outer surface thereof as a freezing surface, a plurality of partition plates projectingly provided on the outer surface of said base plate longitudinally at the spacing of the width of ice cube and a plurality of hollow tubular bodies projectingly provided longitudinally on the back surface of said base plate are integrally fabricated to constitute an ice making plate proper, a distance piece is formed so as to have a plane form corresponding to that of said ice making plate proper and a plurality of lateral partition plates projectingly provided at the location corresponding to the space between two adjacent longitudinal partition plates, said ice making plates proper and said distance pieces are stuck alternately upon each other, cooling tubes are inserted into the hollow portion of said hollow tubular bodies and fixed together to assembled and constitute an ice making plate and a required size and number of ice cube making cells as determined by said base plate, longitudinal partition plate and lateral partition plate are formed in said ice making plate.

Furthermore, another objective of the present invention is to provide, for an ice making plate of an ice making machine, a method of manufacture that is so constructed and characterized that said ice making plate is integrally fabricated by extrusion or drawing of heat conductive material and cooling tubes are tightly fixed to said hollow tubular bodies by expanding after being inserted into the hollow portion thereof.

Furthermore, another objective of the present invention is to provide a method of manufacture of an ice making machine that is characterized in that an ice making plate proper that is composed of said base plate, longitudinal partition plates and hollow tubular bodies is formed integrally by extrusion or drawing and cutting to the length corresponding to the height of ice cube, said ice making plates proper and said distance pieces are stuck alternately upon each other, cooling tubes are inserted into the hollow portion of said hollow tubular bodies of each ice making plate proper and fixed together by expanding and thus an ice making plate having a required size and number of ice cube making cells can be assembled.

Now,in the present invention, it is desirable to provide said hollow tubular body of said ice making plate proper on the inside end thereof with a longitudinally expanding radial slit. This is because said radial slit increases the heat transfer efficiency by tightening the contact between said cooling tube and said hollow tubular body and makes it easy to integrally fabricate the ice making plate proper by extrusion or drawing. Moreover, it is also desirable to hollow the longitudinal partition plate of said ice making plate proper and provide the outer end thereof with a longitudinally extending slit. As with the foregoing, it is because said slit makes it easy to integrally fabricate said ice making plate proper by extrusion or drawing.

Furthermore, it is desirable to install said ice making plate approximately vertically and fabricate said lateral partition plate, at least the outer end thereof, of heat insulating material. It is because no ice making is performed at the outer end of said lateral partition plate where water flows across, the joining-up of the ice in the upper and lower ice cube making cells is prevented and ice cubes of the required size are made available at the same time with the ice cube removal without the need of breaking means, Moreover, it is desirable to fabricate said longitudinal partition plates integrally with a base plate, using heat conductive material and fabricate said lateral partition plates, using heat insulating material. It is also advantageous to outwardly taper said longitudinal and lateral partition plates at the inner surface thereof, since it facilitates the ice cube removal. It is also desirable to hollow said lateral partition plates since it facilitates efficiently the ice cube removal by passing water through said hollow portion at the time of the ice cube removal.

Furthermore, it is desirable to make said ice making plate cylindrical, since it makes it possible to substancially increase the ice making capacity of an ice making plate and consequently the storage capacity thereof due to the relationship of circumference of a circle to the diameter thereof. Therefore it is possible to compactize the ice making plate by this configuration.

When said ice making plate is so constructed that in addition to ice making plate proper of heat conductive material and longitudinal partition plates integrally projected thereon, said lateral partition plate of a distance piece which is made of heat insulating material is clad with a heat transfer surface member of thin sheet metal in order to provide thereon an appropriate degree of heat transfer, it is possible to make ice cube in each ice cube making cell satisfactorily and rapidly by cooling water that is supplied to an ice cube making cell from above and below thereof and at the same time to facilitate the ice cube removal.

BRIEF DESCRIPTION OF THE DRAWINGS

FIG. 1(*a*) is a schematic representation,

FIG. 1(*b*) a perspective view of the back surface of an ice making plate and FIG. 1(*c*) an enlarged fragmental perspective view of an ice making plate.

FIG. 2 is a perspective view illustrating the assembly and disassembly,

FIG. 3 a longitudinal sectional view,

FIG. 4 a perspective view illustrating key components,

FIG. 5 a longitudinal sectional view taken along the line V—V of FIG. 4, FIG. 6 an enlarged perspective view of disassembled ice cube making cells, FIG. 7 and FIG. 8, the plane and side-view of an ice making plate proper.

DETAILED DESCRIPTION OF PREFERRED EMBODIMENT

The embodiment of present invention will be explained in detail in accordance with FIG. 2 through FIG. 11.

FIG. 2 through FIG. 6 show an ice making machine having an ice making plate of this invention wherein the reference symbol(A) is a longitudinal ice making plate of cylindrical type and is assembled by piling up a plurality of short cylindrical ice making plates proper(B) and a plurality of annular spacers are distance pieces(C) so as to hold said ice making plate proper(B) between two distance pieces(C),(C).

Figure 1A:
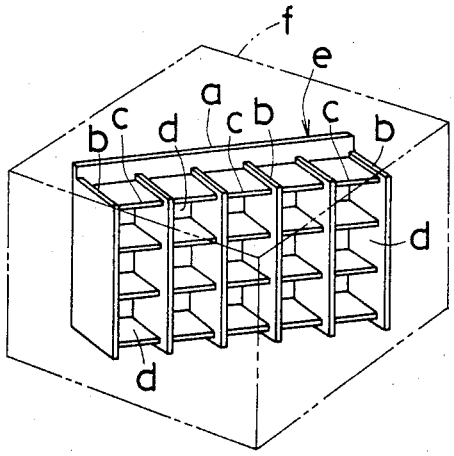
FIGS. 1(*a*)(*b*)(*c*) show a conventional ice making machine.
Figure 1B:
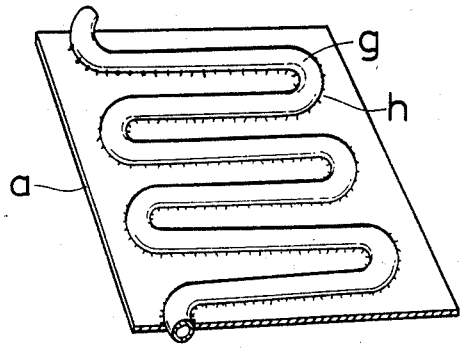
Figure 1C:
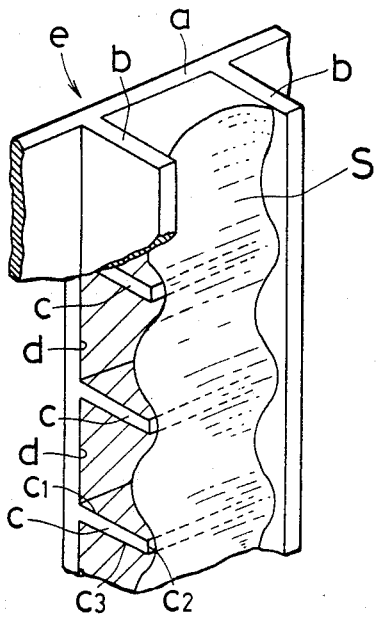
Figure 2:
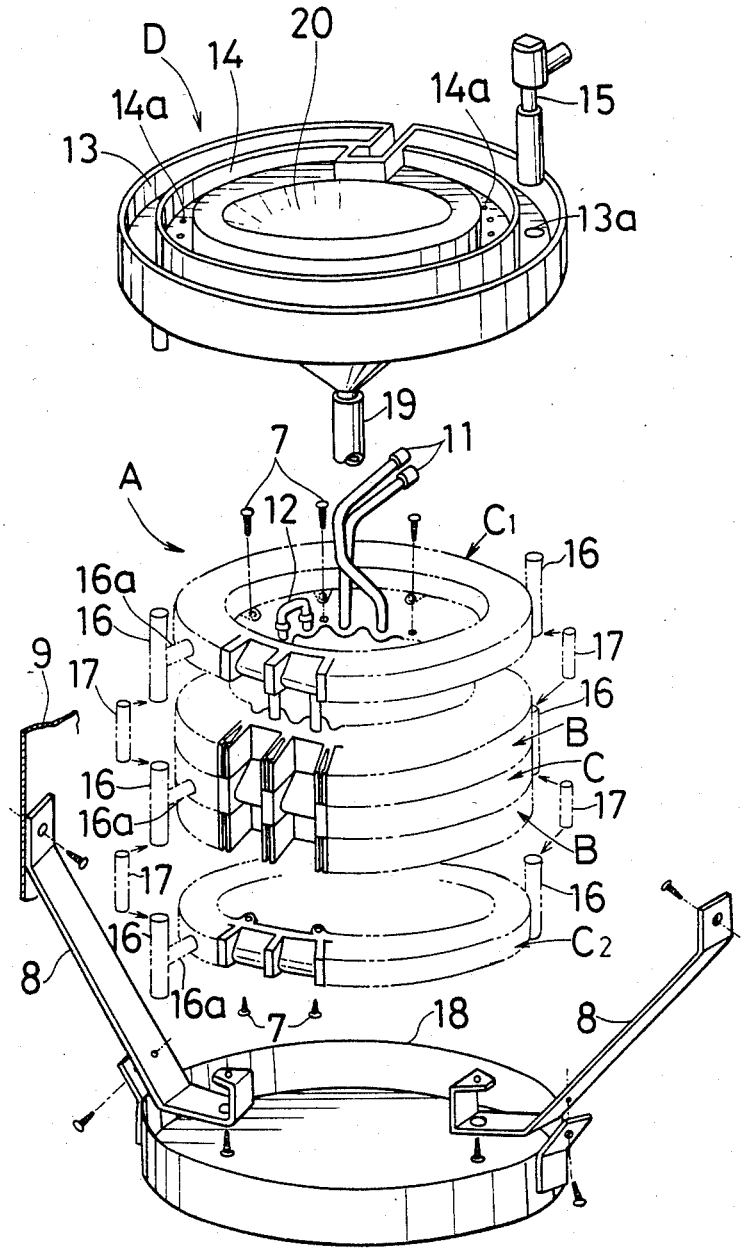
FIG. 2 through FIG. 8 show a preferred embodiment of this invention.
Figure 3:
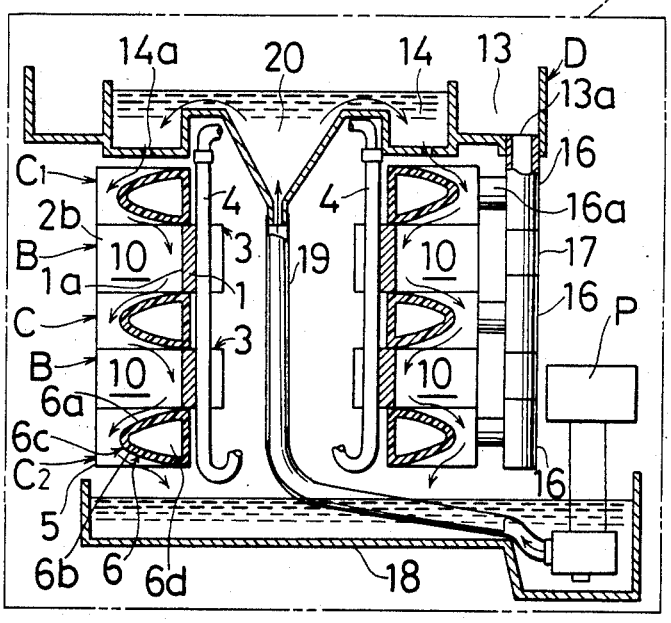
Figure 4:
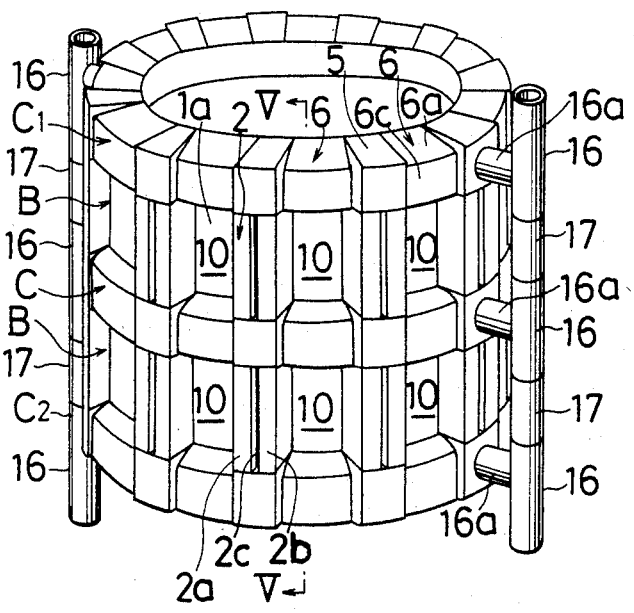
Figure 5:
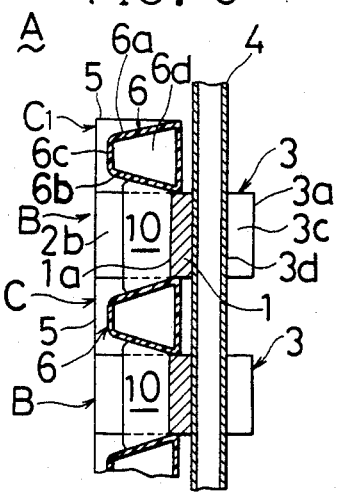
Figure 6:
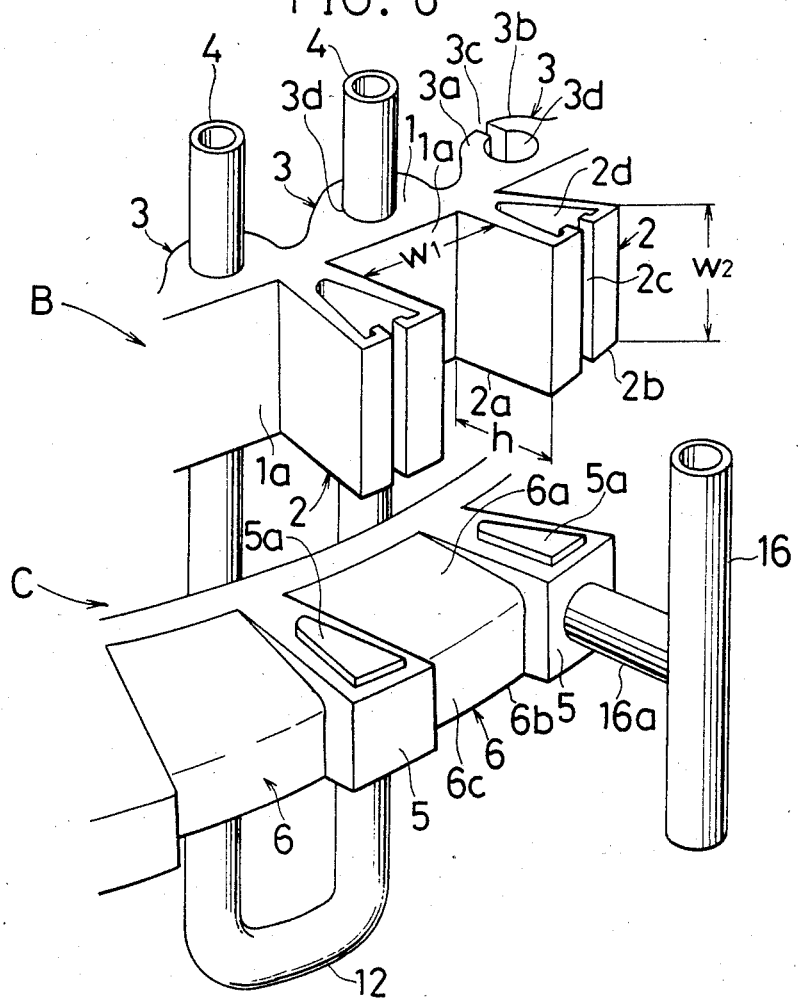
Figure 7:
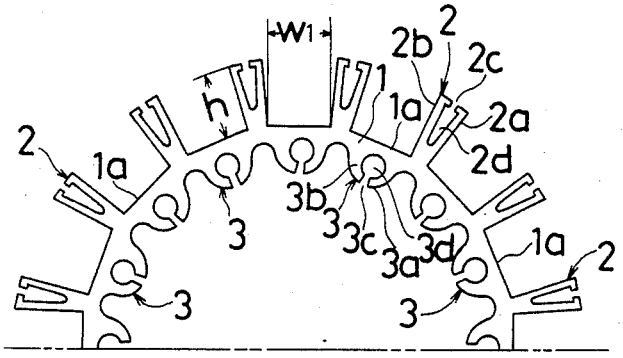
Figure 8:
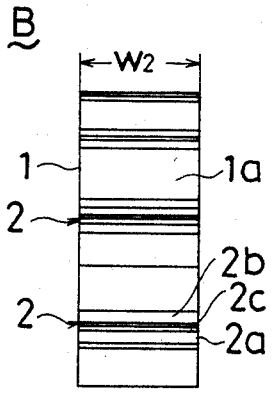

Said ice making plate proper(B) is, as shown in detail in FIG. 7 and FIG. 8, composed of a base plate(1) utilizing outer surface thereof as a freezing surface, a plurality of longitudinal partition plates(2) projectingly provided on the outer surface(1*a*) of said base plate(1) with the height of h and at the spacing of the width W1 of ice cube and a plurality of hollow tubular bodies(3) longitudinally projected on the back surface of said base plate(1) at the location corresponding to the middle location of two adjacent longitudinal partition plates(2)(2), and fabricated integrally by extrusion or drawing of heat conductive material such as alluminum, having a height corresponding to the height W2 of ice cube. Said longitudinal partition plate(2) is so constructed that two wall plates(2*a*)(2*b*) are confronted with each other at the tip thereof so as to hold a hollow space(2*d*) between and leave a slit(2*c*) thereon like character C. The inner surface of said longitudinal partition plate(2), that is, wall plates(2*a*)(2*b*) is outwards tapered in order to make the ice cube removal easy. Furthermore, said hollow tubular body(3) is so constructed that two adjacent bay-shaped walls(3*a*)(3*b*) are confronted with each other at the tip thereof so as to hold a hollow tubular space(3*d*) between and leave a radial slit(3*c*) there for holding cooling tube (4).

On the other hand, said distance pice(C) is fabricated of heat insulating material such as plastics so as to have an annular plane form corresponding to that of said ice making plate proper(B) and is composed of a plurality of hollow insert pieces(5) of the number equivalent to that of said longitudinal partition plates(2) of said ice making plate proper(B) and a plurality of lateral partition plates (6) projectingly provided between two adjacent hollow insert pieces(5)(5) with a height smaller than h and connecting thereto. Said hollow insert pieces(5) is provided on upper and lower surface thereof with a projection part(5*a*) which enters the hollow portion(2*d*) of said longitudinal partition plate(2) at the time of pile-up. Furthermore, the hollow part(6*d*) of said lateral partition plate(6) is constructed so as to communicate with the hollow part of said hollow insert pieces(5)(5) to provide water passage at the time of the ice cube removal and the upper and lower surface thereof (6*a*)(6*b*) are tapered outwards for ease of ice cube removal.

Furthermore, reference number(4) is a cooling tube for flowing refrigerant and is inserted into the hollow portion(3*d*) of said hollow tubular body(3) of an ice making plate proper(B). Ice making plates proper(B) and distance pieces(C) are piled up together so as to hold an ice making plate proper(B) between two distance pieces(C) and cooling tubes(4) are inserted into the hollow portion(3*d*) of said hollow tubular bodies(3) and fixed to said ice making plates proper(B) by tube expanding. Thus intermediate distance pieces other than the top distance piece(C1) and bottom one(C2) are assembled, being tightly fixed between two ice making plates proper(B)(B). The top distance piece(C1) is fixed by screws(7) on the top of said assembly of ice making plates proper(B) and distance pieces(C) and the bottom of said assembly is fixed to the support member(8) by screws (7), holding the bottom distance piece(C2) between, which is fixed to the casing(9) by means of said support member(8). Thus a longitudinal ice making plate(A) which is installed approximately vertically in the casing is constructed and at the same time, a required number and size of ice cube making cells(10) are formed longitudinally and laterally by means of the base plate surface(1*a*) of said ice making plate proper(B), the inner surfaces(2*a*)(2*b*) of longitudinal partition plates thereof and the inner surfaces(6*a*)(6*b*) of the lateral partition plates(6) of said distance pieces(C). By the way, the reference number(11) is a connection tube for cooling tubes(4) and the reference number(12) is a U tube for connecting two adjacent cooling tubes(4)(4) at the top and bottom thereof.

Furthermore, the reference symbol(D) is a water sprinkling tank provided above said ice making plates(A), having two concentric annular water sprinkling chambers(13)(14) and the outer annular water sprinkling chamber(13) is supplied with water from a water supply pipe(15) and the inner water sprinkling chamber(14) is installed above said ice making plate(A). The reference number(16) is a water piping for passing water at the ice cube removal and arranged so as to communicate with the hollow part of each distance piece(C) through a water connection(16*a*) provided outwards on each distance piece(C) at the location corresponding to each other vertically. Each water piping(16) is connected with each other through a hose(17) and the upper end of the water piping(16) of the top distance piece(C1) is connected to the water sprinkling port(13*a*) provided on the bottom of the outer water sprinkling chamber(13) of said water sprinkling tank(D). The lower end of the water piping(16) of the bottom distance piece(C2) is arranged so as to drain water into the water tank(18) that is installed below the ice making plate(A). In case of ice cube removal, water stored in the outer water sprinkling chamber(13) is supplied through the water piping(16) to the hollow part of each distance piece (C) and then falls into said water tank(18). Furthermore, a water supply pipe(19) is connected with said water tank (18) through the water supply pump(P) installed therein and the upper end of said water supply pipe(19) communicates with the inner water sprinkling chamber(14) through the hopper type supply port(20) installed in the middle of said water sprinkling tank(D). Water taken in from the water tank(18) overflow across the circumference of said supply port(20) into the inner water sprinkling chamber(14) and is uniformly sprinkled over the ice making plate(A) through a great number of small sprinkling ports(14*a*) installed on the bottom of said inner water sprinkling chamber (14) and freezed into ice by flowing through each ice cube making cell(10) downwards.

Next, the operation of said embodiment will be explained.

In case of ice making, it is first necessary to circulate liquid refrigerant in the cooling tube(4) and cool down the base plate surface(1*a*), wall plates(2*a*)(2*b*) of longitudinal partition plates(2) which respectively constitute ice cube making cells(10) of said ice making plate(A). On the other hand, water is uniformly sprinkled over the upper surface of the top distance piece(C1) through a great number of small sprinkling ports(14*a*) of the inner water sprinkling chamber(14) of the water sprinkling tank(D) and flow downwards, successively wetting the upper surface(6*a*) of the lateral partition plate(6) of each distance piece (C), the outer end surface(6*c*) thereof, the lower surface (6*d*) thereof and each base plate surface(1*a*) of ice making plates proper(B) and thus ice cubes are formed in respective ice cube making cells(10). After ice cubes have been made, hot refrigerant gas is passed through the cooling tube(4) to heat up the base plate surface(1*a*) and wall plates(2*a*)(2*b*) of the longitudinal partition plate(2) and at the same time, water is passed from the water sprinkling port(13*a*) of the outer water sprinkling chamber(13) of the water sprinkling tank(D) to the hollow part of each distance piece(C) through the water pipe(16) and thus ice cubes are removed from ice cube making cells(10) and drop into the beneath ice storage bin.

In this case, since ice cube making cells(10) are formed by base plates(1), longitudinal partition plates(2), and lateral partition plates(6) of an ice making plate(A) that is constructed by piling up the ice making plates proper(B) comprising of a base plate(1) and longitudinal partition plates(2) having a height corresponding to that of ice cube W2 and distance pieces(C) having lateral partition plates(6), it is possible to obtain ice cubes of a desired size by changing the height of said ice making plate proper (B) and it is also possible to obtain ice cubes of a desired number by changing the number of pile-up of ice making plates proper (B) and distance pieces(C). Thus it is easy to make ice cubes of a required number and size and make changes in the ice making capacity.

Furthermore, since the lateral partition plate(6) wetted by water is made of heat insulating material such as plastics, no ice making is performed at the outer end surface(6c) of said lateral partition plate(6), which prevents the join-up of the ice in the upper and lower ice cube making cells, making it possible to produce ice cubes independently without the need of breaking means for ice cube removal. At the time of ice cube removal, when water is passed through the hollow part of each distance piece(C) from the water sprinkling port(13a) of the outer water sprinkling chamber(13) of said water sprinkling tank(D) through the water piping(16), the ice cube removal is made more easily. Further, since the lateral partition plate(6) of said distance piece (C) is made of heat insulating material, it is possible to properly perform ice cube removal. Moreover, it is more easy for ice cube removal to construct the inner surfaces of the longitudinal partition plate(2), thath is, wall plates thereof (2a)(2b) and the inner surfaces, that is, upper and lower surfaces(6a)(6b) so as to be outwards tapered.

Furthermore, the longitudinally extending radial slit (3c) that is provided on the inner end of the hollow tubular body(3) of said ice making plate proper(B) so as to communicate with said hollow portion(3d) results in the more tight contact with cooling tube(4) due to spring action of spliting die when cooling tubes(4) are inserted into said hollow portion(3d) and improves the heat transfer characteristics and consequently the efficiency of ice cube making and at the same time ensures the rigid and accurate assembly of an ice making plate(A).

Furthermore, since said ice making plate(A) is of a cylindrical type and ice cubes are formed longitudinally and circumferentially on the outer surface of said ice making plate(A), the number of ice cube making cells(10) is increased, as compared with an ice making plate of a flat plate type, approximately by the factor $\pi$ due to the relationship of the circumference of a circle to its diameter and the ice cube making capacity is substancially increased. Moreover, since ice cubes that fall by gravity from ice cube making cells(10) after ice cube removal, are accumulated along the circular circumference below the cylindrical ice making plate(A), it is possible to make good use of the space inside the casing(9) for ice cube storage. Thus the compactization of an ice making machine can be realized through the increase in the capacity of ice making and storage. Moreover, it is advantageous to install the refrigeration mechanism and water piping in the inside space of a cylindrical ice making plate(A). Furthermore, since ice cube making cells(10) are provided on the outer surface of a cylindrical ice making plate(A), it is easy to outwards taper the inner surfaces of said ice cube making cells(10) for ease of ice cube removal. By the way, although the said casing(9) is, in general, of a box type as shown in the figure, it may be of a different shape such as a cylinder and a cylindrical polygon, which makes no difference in the effect.

Next, the method of the manufacture of said ice making plate(A) will be explained. First, an ice making plate proper(B) that is composed of a base plate(1) and longitudinal partition plates(2) and hollow tubular bodies(3) is integrally fabricated by extrusion or drawing of heat conductive material and then cut to the length corresponding to the height W2 of ice cubes.

Though said ice making plate proper(B) is of a complicated configuration wherein a base plate(1), longitudinal partition plate(2) provided on the outer surface thereof and hollow tubular bodies(3) provided the back surface thereof are integrated, since both longitudinal partition plates(2) which are projected on the outer surface and hollow tubular bodies(3) which are projected on the back surface are extending longitudinally, it is possible to integrally fabricate extrusion or drawing in this longitudinal direction and it is easy to manufacture an ice making plate proper(B) by cutting to the desired length after extrusion or drawing. Especially, when a longitudinally extending slit(3c) is provided on the inner end of said hollow tubular body(3) so as to communicate with the hollow portion(3d) thereof and said longitudinal partition plate(2) is constructed so as to have a hollow portion(2d) therein and radial slit(2c) communicating with said hollow portion(2d) at the tip thereof, said fabrication by extrusion or drawing becomes more easy and the accuracy of the diameters in said hollow portions(2d)(3d) is improved. At the same time, only one pair of inner and outer dies are sufficient for extrusion or drawing and dies themselves are easy to make.

Next, after ice making plates proper(B) constructed as stated above and distance pieces(C) having lateral partition plates(6) are piled up upon each other, cooling tubes(4) are inserted into the hollow portions(3d) of said hollow tubular bodies(3) and fixed thereto by tube expanding, thus an ice making plate(A) being assembled.

In this case, since cooling tubes(4) are fixed to ice making plates proper(B) only by expanding tubes inserted into said hollow portions(3d) and distance pieces(C) are fixed by being tightly hold between ice making plates proper(B),(B), it is possible to assemble an ice making plate(A) easily and rapidly. By the way, the top and bottom distance pieces (C1)(C2) are fixed to said assembly by screws(7).

An ice making plate(A) manufactured as above stated has a substantially low manufacturing cost due to the ease of manufacture and assembly. Furthermore, in case of making changes in the ice cube making capacity by changing the size and number of ice cube making cells(10), it has a very good workability.

Figure 9:
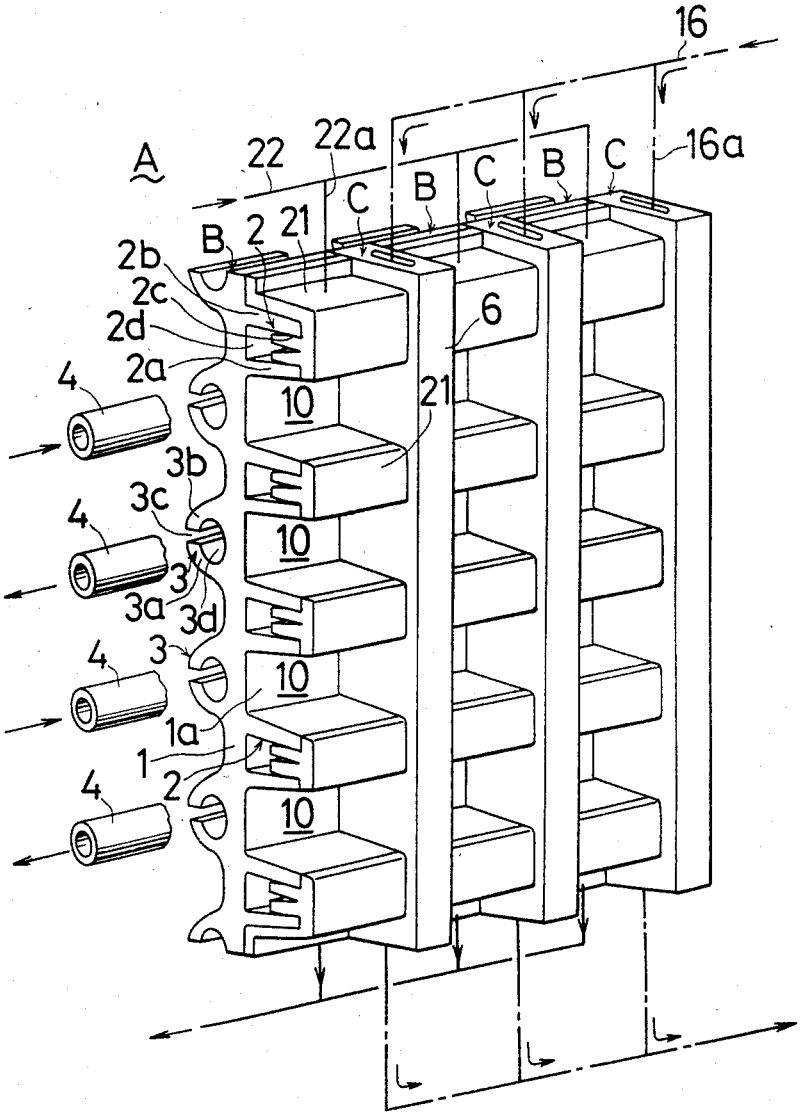
FIG. 9 is a perspective view showing a variation of the embodiment of this invention, FIG. 10 an enlarged fragmental sectional view showing another variation of the embodiment of this invention and FIG. 11 a perspective view of the heat transfer surface member of FIG. 10.

While a longitudinal ice making plate(A) of a cylindrical type has been explained in the above description, this invention is not limited to the above but it may be of a flat plate type. In case of a flat plate type, two cases, that is, a flat plate development of said cylindrical ice making plate and 90 degree turn of said flat plate type ice making plate are considered. Since the former is the same as the cylindrical ice making plate, the explanation thereon is omitted and the latter will be detailed. As shown in FIG. 9, ice making plates proper(B) and distance pieces(C) are longitudinally disposed alternately and assembled and fixed together by inserting cooling tubes(4) thereto and expanding. In this case, a piece(21) made of heat insulating material such as plastics is inserted between wall plates (2a)(2b) of each longitudinal partition plates(2) (in this case, laterally disposed) of an ice making plate(A). In case of making ice cubes by this embodiment, low-pressure refrigerant liquid flow through the cooling tube(4). On the other hand, water is dripped, from each branch pipe(22a) of a water pipe(22), over the upper surface of each partition plate and successively wets the upper wall plate(2a) of each partition plate(2), piece(21), lower wall plate(2b) and the surface(1a) of base plate(1), thus ice cubes being made in ice cube making cells(10). After ice cubes have been made, hot refrigerant gas is circulated in cooling tubes and water is passed, from each branch pipe(16a) of the pipe(16), through the hollow part of each distance piece(C), thus ice cubes being released from ice cube making cells(10).

Furthermore, lateral partition plates(6) constituting ice making cells(10) are made entirely of heat insulating material in the foregoing embodiment, it is sufficient, in this case, to make at least the outer end surface of lateral partition plates(6) as shown in FIG. 9.

Figure 10:
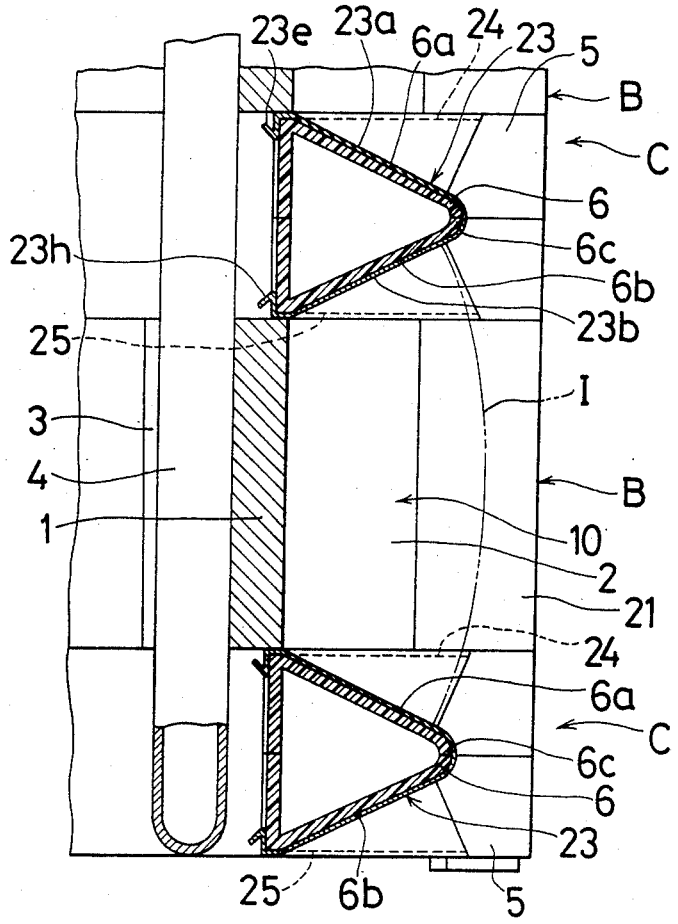
Figure 11:
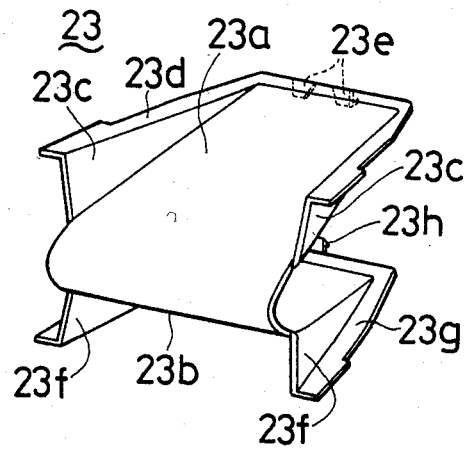

Furthermore, FIG. 10 shows another variation of the embodiment of this invention wherein the surface(6*a*)(6*b*)(6*c*) of lateral partition plates(6) of each distance piece(C) is clad with a heat transfer surface member(23) of degreased thin sheet metal such as alluminum and stainless steel. Said heat transfer surface member(23) is as shown in FIG. 11 composed of the upper and lower surface portions(23*a*)(23*b*) that is clothing close over the lateral partition plate(6) of the distance piece(C) and forming to be like approximately character V, the upper side wall portion(23*c*)(23*c*) that extends from both ends of said upper surface portion(23*a*) and contacts tightly with the sides of longitudinal partition plate(5) of said distance piece(C), the upper flange portion(23*d*) that extends outwards continuously from the upper end of said side wall portion(23*c*) and upper surface(23*a*) and fits in on the upper notched portion(24) that is provided, with the thickness of said thin sheet metal, on the longitudinal partition plate(2) and the base portion of said lateral partition plate(6), the upper stopper(23*e*) that extends downwards from the rear end of said upper flange portion(23*d*) and grasps the back surface of the base portion of said lateral partition plate(6), the lower side wall portion(23*f*)(23*f*) that extends downwards from both ends of said lower surface portion(23*b*) and contacts tightly with the sides of longitudinal partition plate(5) of said distance piece(C), the lower flange portion(23*g*) that extends outwards continuously from the end of said side wall portion(23*f*) and said lower surface portion(23*b*) and fits in on the lower notched portion(25) that is similarly provided on the longitudinal partition plate(5) and the base portion of said lateral partition plate(6) and the lower stopper (23*h*) that extends upwards from the rear end of said lower flange(23*g*) and grasps the back surface of the base portion of said lateral partition plate(6). By elastically deforming said upper and lower surface(23*a*)(23*b*) so as to expand outwards, the surfaces(6*a*)(6*b*)(6*c*) are so clad with said heat transfer surface member(23) that the upper and lower flanges (23*d*)(23*g*) fits in on the notched portions(24)(25) and the upper and lower stoppers grasp the back surface of the base portion of said lateral partition plate(6). Moreover, with intermediate distance pieces(C), said heat transfer surface member(23) is pressed contacted with ice making plates proper (B) by assembling said ice making plates proper(B), thus said heat transfer member(23) being contacted at the part (the upper and lower flange portion(23*d*)(23*g*) to keep ice making plate proper(B) conductive, by means of expanding of cooling tubes inserted and with the top and bottom distance pieces(C1)(C2), said surface member(23) is pressed contacted with ice making plates proper(B) by installing top and bottom distance pieces(C1)(C2) with connection bands and so on.

Since the surfaces(6*a*)(6*b*)(6*c*) of the lateral partition plates(6) of said distance piece(C) is, in this case, clad with a heat transfer surface member(23) which contacts partially with said ice making plate proper(B), water to besupplied into ice cube making cells(10) is also cooled by ice making plate proper(B) and cooling tubes(4) while passing across the surfaces(6*a*)(6*b*)(6*c*) of said lateral partition plates(6). For this reason, ice cubes are made in the ice cube making cells (10) not only through the base plate(1) and wall plates of left-hand and right-hand longitudinal partition plates(2) of said ice making plate proper(B) but also through the surfaces(6*a*)(6*b*)(6*c*) of lateral partition plates(6) in the upper and lower distance pieces(C), thus ice cubes of a definite shape(I) corresponding to that of an ice cube making cell shown by a chain line in FIG. 10 being rapidly made. Furthermore, since said heat transfer surface member(23) is made of degreased thin sheet metal having a good affinity with water, it is possible to produce the above intended effect efficiently without the trouble of the deformation of ice cubes and water dripping.

Ice cube removal, while hot refrigerant gas is passed through cooling tubes(4) and the ice cube in each ice cube making cell(10) is released, it is possible to perform ice cube removal rapidly because heat is transfered also through said heat transfer surface member(23). Especially because the temperature difference (20 to 80 degree C., average 50 degree C.) between the temperature of ice cube making cell(10) (the temperature of ice, 0 degree C.) and that of an evaporator (hot refrigerant gas temperature, 20 to 80 degree C., average 50 degree C.) is, at the time of ice cube removal, substantially large as compared with the temperature difference at the time of making(20 degree C.) between the temperature of an evaporator (the refrigerant temperature −20 degree C.), the heat transfer effect produced by such as metal plated layer, which is advantageous to greatly reduce the time of ice cube removal.

As detailed above, an ice making plate of an ice making machine of this invention consists of ice making plates proper that are integrally fabricated and constituted of base plates utilizing outer surface thereof as freezing surface, a plurality of longitudinal partition plates projectingly provided with a spacing of the width of ice cube on the outer surface of said base plate and a plurality of longitudinal hollow tubular bodies projectingly provided on the back surface of said plate, and cooling tubes inserted into said hollow tubular bodies. Since said ice making plate can be constructed by integrally fabricating said base plate, longitudinal plates and hollow tubular bodies and inserting cooling tubes into said hollow tubular bodies, the manufacturing operation of the ice making machine as well as the ice making plate is improved as compared with that of the conventional system and cost reduction can be realized. Furthermore, even when alluminum is used as the material of said ice making plate proper, although it is somewhat inferior in heat conductivity to copper of conventional use, it causes no problems when heat resistance all over the ice making plate is considered because heat resistance of alluminum is of a negligible order as compared with that between water and ice.

Furthermore, since an ice making plate is assembled by piling up alternately ice making plates proper that are integrally composed of base plates, longitudinal partition plates and hollow tubular bodies and distance pieces having lateral partition plates, and constructed to form a required size and number of ice cube making cells by said base plate, longitudinal partition plates, it is easy to make changes in the ice cube making capacity by changing the height of said ice making plate proper or by the height of said assembly of ice making plates proper and distance pieces, which makes it possible to assemble ice making plates of different capacity with versatility and by means of one set of dies.

Furthermore, with an ice making machine of longitudinal ice making plate type that has a plurality of ice cube making cells longitudinally, when the lateral partition plate that constitutes said ice cube making cell is made of, at least at the outer end thereof, heat insulating material, it is possible to make ice cubes independently from each other, which eliminates the need of a separate breaking means and realizes the simplification of the construction and the efficient operation of ice cube making. In addition, when said lateral partition plate is constructed so as to have a hollow part in order to pass water at the time of ice cube removal, it is possible and advantageous to remove ice cube efficiently.

Furthermore, when an ice making machine having an ice making plate longitudinal cell type is so constructed that said ice making plate is of a cylindrical type and have a large number of ice cube making cells longitudinally and circumferentially on the outer surface of said ice making plate, it is possible to substantially increase the capacity of ice making and storage within the limited space, which results in the compactization of an ice making machine that has a good practical effect.

Furthermore, with respect to the method of manufacture of an ice making plate of an ice making machine of this invention, though an ice making plate proper is of a complicated configuration wherein said base plate, said longitudinal partition plates provided on the outer surface thereof and said hollow tubular bodies provided on the back surface thereof are integrally fabricated, since partition plates projected on the outer surface and hollow tubular bodies projected on the back surface are longitudinally extending, it is possible to fabricate at one process by extruding or drawing in this direction. Furthermore, as explained about the assembly of an ice making machine in the above stated embodiment, not only are cooling tubes fixed to ice making plates proper only by inserting them into the hollow portion of said hollow tubular bodies and subsequent expanding, but also is an ice making machine assembled and fixed by piling up ice making plates proper and distance pieces alternately. Therefore it becomes very easy to integrally fabricate an ice making plate proper and alluminum which is cheaper than copper is applicable to use as construction material, which results in low manufacturing cost. Furthermore, since the assembly is almost completed by expanding of cooling tubes, an ice making plate of an ice making machine of this invention has a feature of a good workability and a remarkably low manufacturing cost as a whole. By the way, when ice making plates proper are made of alluminum and cooling tubes, of copper, it is necessary to provide the entire ice making plates proper with Alumite in order toprevent from electrolytic corrosion.

Moreover, when said hollow tubular body is provided on outer end thereof with a longitudinally extending radial slit that communicates with the hollow portion thereof, the contact with the cooling tube inserted therein is improved due to the spring action of the splitting die and the improved accuracy of fabrication of the inner surface of said hollow portion as is explained above, which not only results in the improvement in heat transfer characteristics due to the improvement in the tight contact but also makes it easy to fabricate said ice making plate proper by extrusion or drawing and make dies as well. Furthermore, when said longitudinal partition plate is constructed so as to hold a hollow portion and provided a longitudinally extending slit, the integral fabrication of said ice making plate proper by extrusion or drawing becomes, as same with the foregoing, easy, the accuracy being improved and the manufacture of the dies becomes easy.

Furthermore, since this method of manufacture makes it possible to easily fabricate said ice making plate proper integrally by extrusion or drawing and subsequent cutting, to use alluminum which is cheaper than copper as construction material, to increase the ice making capacity only by additional pile-up of ice making plates proper and distance pieces and subsequent tube expanding, it has a feature of a good workability and a low cost. At the same time, with this method, the assembly is almost completed by the expansion of cooling tubes, which results in a remarkably good workability and a substantially low manufacturing cost with an advantage of eliminating the need of large dies and jigs.

While the invention has been described and disclosed in terms of several embodiments or modifications which it has assumed in actual practice, the scope of the invention should not be deemed to be limited by the precise embodiments or modifications, such other embodiments or modifications being intended to be reserved especially as they fall within the scope of the claims hereto appended.

What is claimed is;

1. An ice making comprising: a vertical array of a plurality of alternately disposed, horizontal, thermally conductive and thermally non-conductive strips, said thermally conductive strips having an ice making surface disposed on at least one side thereof; means for withdrawing sufficient heat from the thermally conductive strips to freeze water; a plurality of vertically oriented spacers extending at least across the ice making surface of the thermally conductive strips at spaced intervals thereon; means for supplying water to the top of the vertical array of strips; and means for collecting unfrozen water at the bottom of the vertical array and recirculating the collected water to the top of the vertical array.

2. An ice cube making machine comprising:

a plurality of base plates each having a front surface which constitutes a freezing surface, a plurality of longitudinal partition plates projecting from said front surface and laterally spaced from each other by the width of an ice cube to be made, and a plurality of longitudinal hollow tubular bodies projecting from the back surface thereof and laterally spaced therealong, said partition plates and tubular bodies being integrally formed on said base plate to constitute an ice making plate;

at least one hollow spacer having a base with a front surface corresponding to the front surface of said base plate of said ice making plates and having a plurality of longitudinal insert pieces projecting therefrom and spaced laterally along said front surface at distances the same as said longitudinal partition plates are spaced, and a lateral partition plate projecting from said base between each two adjacent longitudinal insert pieces, said ice making plates and said spacer being stacked alternately upon each other with said front surfaces and said partition pieces and insert pieces aligned, said base plates, longitudinal partition plates and lateral partition plates defining among them ice cube making cells, and said longitudinal hollow bodies on each ice making plate being aligned with corresponding longitudinal hollow bodies on the other ice making plates; and cooling fluid tubes extending through the aligned longitudinal hollow bodies and fixed thereto in heat conducting relationship.

3. An ice making machine as claimed in claim 2 wherein each hollow tubular body has a longitudinally extending slit on the outer end thereof remote from said base plate.

4. An ice making machine as claimed in claim 2 wherein each longitudinal partition plate has a hollow interior and has a longitudinally extending slit in the outer end thereof in communication with the hollow interior thereof.

5. An ice making machine as claimed in claim 2 wherein said ice making plate extends roughly vertically and at least the outer end of each lateral partition plate is made of heat insulating material.

6. An ice making machine as claimed in claim 2 wherein each longitudinal partition plate is made of heat conductive material and each lateral partition plate is made entirely of heat insulating material.

7. An ice making machine as claimed in claim 2 wherein the outer surfaces of each of the longitudinal partition plates and lateral partition plates that define the ice cube making cells are tapered outwards away from the outer surfaces of the opposed plates so as to facilitate the fall of an ice cube therefrom by gravity.

8. An ice making machine as claimed in claim 2 wherein each lateral partition plate has a hollow interior, and said machine further comprises means to pass heated fluid therethrough for ice cube removal.

9. An ice making machine as claimed in claim 2 wherein said ice making plates are cylindrical and positioned horizontally one above the other, and said ice cube making cells extend horizontally and circumferentially around the outer surface of said ice making plates.

10. An ice making machine as claimed in claim 2 wherein each spacer is made of heat insulating material and the surfaces of the lateral partition plates thereof are clad with a heat transfer surface member of thin sheet metal, said heat transfer surface member having a part thereof in contact with said ice making plate.

11. Method of making an ice cube making machine comprising:

drawing or extruding a heat conductive material into an elongated ice making plate member having a base plate having a front surface which constitutes a freezing surface, a plurality of longitudinal partition plates projecting from said front surface and laterally spaced from each other by the width of an ice cube to be made, and a plurality of longitudinal hollow tubular bodies projecting from the back surface thereof and laterally spaced therealong;

cutting said elongated ice making plate member transversely of the direction of elongation thereof into a plurality of separate ice making plates each having a thickness corresponding to the height of an ice cube to be made;

stacking at least two of said ice making plates one above the other with a hollow spacer therebetween, said hollow spacer having a base with a front surface corresponding to the front surface of said base plate of said ice making plates and having a plurality of longitudinal insert pieces projecting therefrom and spaced laterally along said front surface at distances the same as said longitudinal partition plates are spaced, and a lateral partition plate projecting from said base between each two adjacent longitudinal insert pieces, the stacking causing said front surfaces and said partition pieces and insert pieces to be aligned, and said base plates, longitudinal partition plates and lateral partition plates to define among them ice cube making cells, and causing said longitudinal hollow bodies on each ice making plate to be aligned with corresponding longitudinal hollow bodies on the other ice making plates; and inserting cooling fluid tubes extending through the aligned longitudinal hollow bodies and expanding the tubes where they pass through said longitudinal hollow bodies to fix said tubes thereto in heat conducting relationship.

12. A method as claimed in claim 11 in which, during said drawing or extrusion step, the outer end of each of said hollow tubular bodies is provided with a slit extending along the length thereof opening into the hollow interior thereof.

13. A method as claimed in claim 11 in which, during said drawing or extrusion step, said longitudinal partition plates are made hollow and the outer end of each of said longitudinal partition plates is provided with a slit extending along the length thereof opening into the hollow interior thereof.

* * * * *